US006540584B1

(12) United States Patent
Olsen

(10) Patent No.: US 6,540,584 B1
(45) Date of Patent: Apr. 1, 2003

(54) TOY SYSTEM

(75) Inventor: Gert Olsen, Bagsvaerd (DK)

(73) Assignee: Brio AB, Osby (SE)

( * ) Notice: Subject to any disclaimer, the term of this patent is extended or adjusted under 35 U.S.C. 154(b) by 0 days.

(21) Appl. No.: 10/015,692

(22) Filed: Dec. 17, 2001

(51) Int. Cl.[7] ..... A63H 18/00; B61L 29/00
(52) U.S. Cl. ..... 446/444; 446/129; 246/473 R
(58) Field of Search ..... 446/476, 444, 446/445, 448, 129; 246/473 R, 473 A; 104/DIG. 1

(56) References Cited

U.S. PATENT DOCUMENTS 1,378,421 A * 5/1921 Miller ..... 246/31
1,391,322 A * 9/1921 Jones ..... 104/298
1,427,881 A * 9/1922 Wessel ..... 246/128
1,857,933 A * 5/1932 Becker ..... 246/81
4,369,943 A * 1/1983 Hussein ..... 246/127
5,916,007 A * 6/1999 Maxim ..... 446/130

* cited by examiner

*Primary Examiner*—Jacob K. Ackun
*Assistant Examiner*—Faye Francis
(74) *Attorney, Agent, or Firm*—Browdy and Neimark

(57) ABSTRACT

A toy system has at least one toy vehicle having wheels, and at least one toy object having a member, which is movable between an initial position and an active position. The toy object has an operating element, which is movable between a first position, in which it is adapted to hold said member in its initial position, and a second position, in which said member is allowed to be moved from its initial position to its active position. At least one of the wheels of the toy vehicle includes a part, which is adapted, when the toy vehicle is moved to a position adjacent to the operating element, to interact magnetically with the operating element to move it from its first position to its second position.

7 Claims, 5 Drawing Sheets

TOY SYSTEM

FIELD OF THE INVENTION

The present invention relates to a toy system comprising at least one toy vehicle having wheels, and at least one toy object, having a member, which is movable between an initial position and an active position.

BACKGROUND ART

A prior-art toy system of this kind is included in a toy railway kit, and the toy object thereof has a rail element having a roadway, which crosses the track of the rail element, marked thereon. The toy object further has a member forming a level-crossing gate, which is pivotable between a raised vertical position and a lowered horizontal position, in which it extends across the roadway. The level crossing gate is manually moved between both positions by the child playing with the toy system.

SUMMARY OF THE INVENTION

One object of the present invention is to provide a toy system so constructed that the movable member of its toy object is automatically moved from its initial position to its active position as the toy vehicle approaches the toy object.

According to the invention, this object is achieved by a toy system which is of the type mentioned by way of introduction and in which the toy object has an operating means, which is movable between a first position, in which it is adapted to hold said member in its initial position, and a second position, in which said member is allowed to be moved from its initial position to its active position, wherein at least one of the wheels of the toy vehicle includes a part which is adapted, when the toy vehicle is moved to a position adjacent to the operating means, to interact magnetically with the operating means to move it from its first position to its second position.

Preferably the operating means supports a permanent magnet and said part is made of a magnetic material and hence is adapted to interact with the operating means by magnetic attraction. Said part is preferably a hub-cap-like part.

In a preferred embodiment said member is influenced by a force acting in the direction of the active position of said member. This force is preferably the force of gravity.

In another preferred embodiment the toy system further comprises a rail element, which is a component of a toy railway, wherein the toy vehicle is adapted to be moved on the rail element and the toy object with the operating means is mounted on the rail element. The movable member of the toy object is preferably a level-crossing gate, which is pivotable between a raised initial position and a lowered active position.

BRIEF DESCRIPTION OF THE DRAWINGS

The invention will now be described in more detail with reference to the accompanying drawings illustrating a preferred embodiment of the invention.

DESCRIPTION OF THE PREFERRED EMBODIMENT

Figure 1:
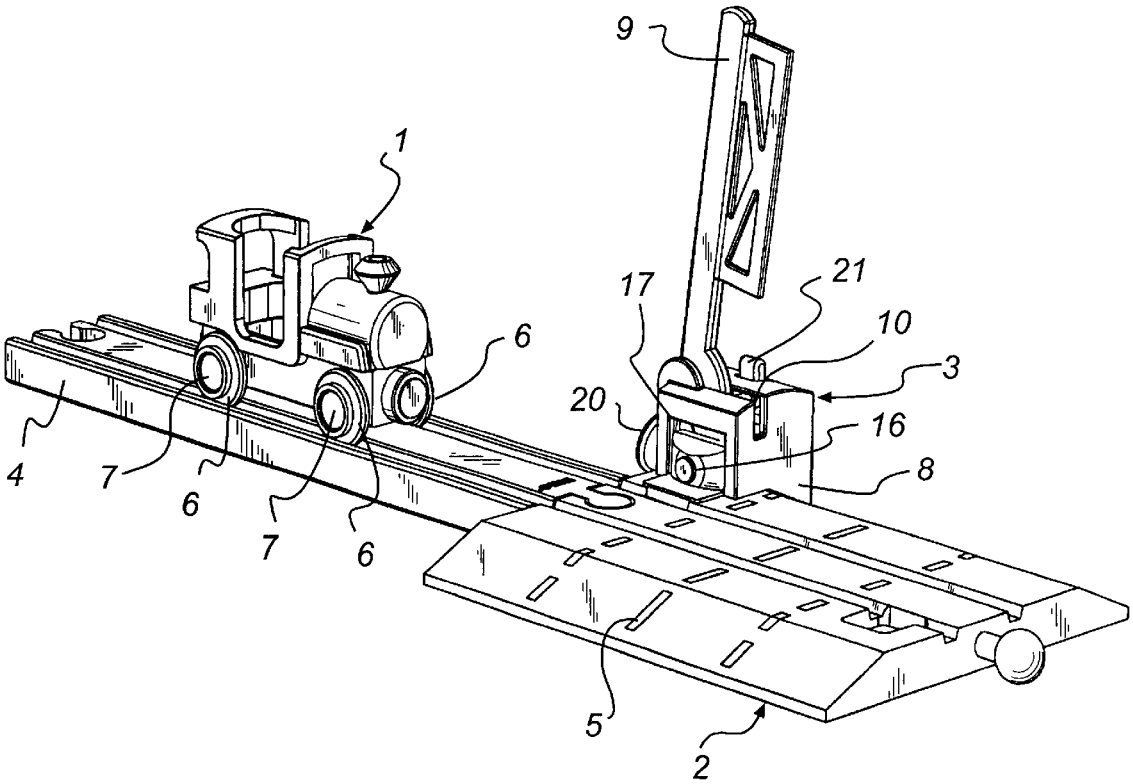
FIG. 1 is a perspective view showing a toy system according to the invention, the toy system being shown with a toy vehicle at some distance from a toy object and with a level-crossing gate in a substantially vertical position.
Figure 2:
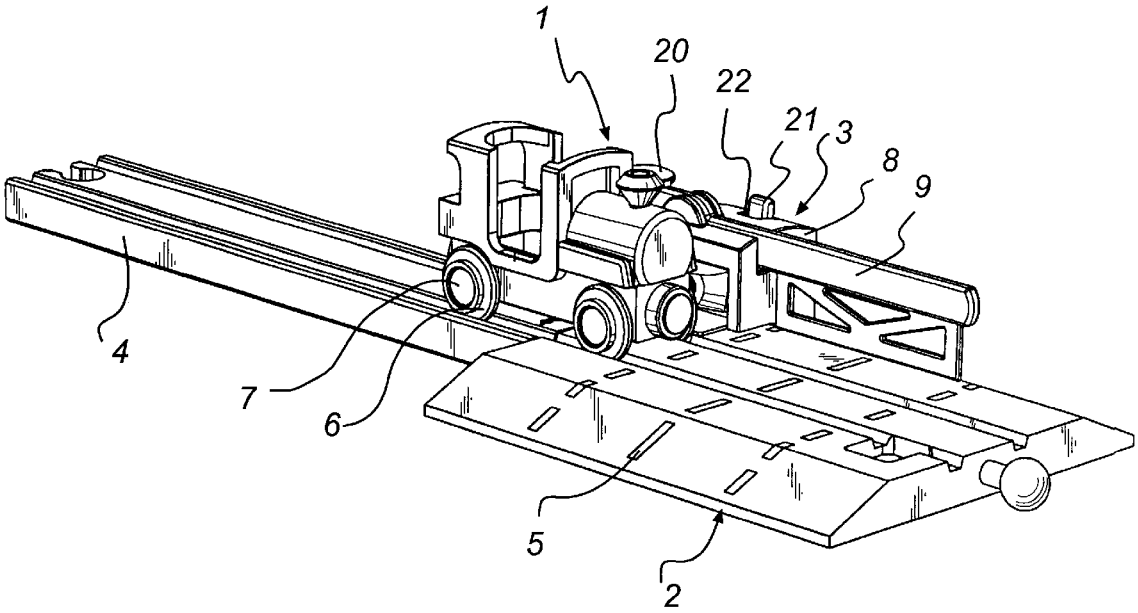
FIG. 2 is a perspective view corresponding to FIG. 1 but showing the toy system with the toy vehicle adjacent to the toy object and the level-crossing gate in a horizontal position.

The toy system illustrated in FIGS. 1 and 2 has a toy vehicle 1 in the form of a toy locomotive, a rail element 2 and a toy object 3 attached to the rail element 2.

The toy vehicle 1 is part of a toy train (not shown) driven on a railway track composed of wooden rail elements 2, 4 coupled to each other. Only two of these rail elements 2, 4 are shown in FIGS. 1 and 2. One of the rail elements shown is the rail element 2, which has a roadway 5, which crosses the track, marked thereon. The toy vehicle 1 has four wheels 6, each having a hub-cap-like part 7. This part 7 is made of a magnetic material, i.e. it will be attracted by a magnet placed close to it.

Figure 4:
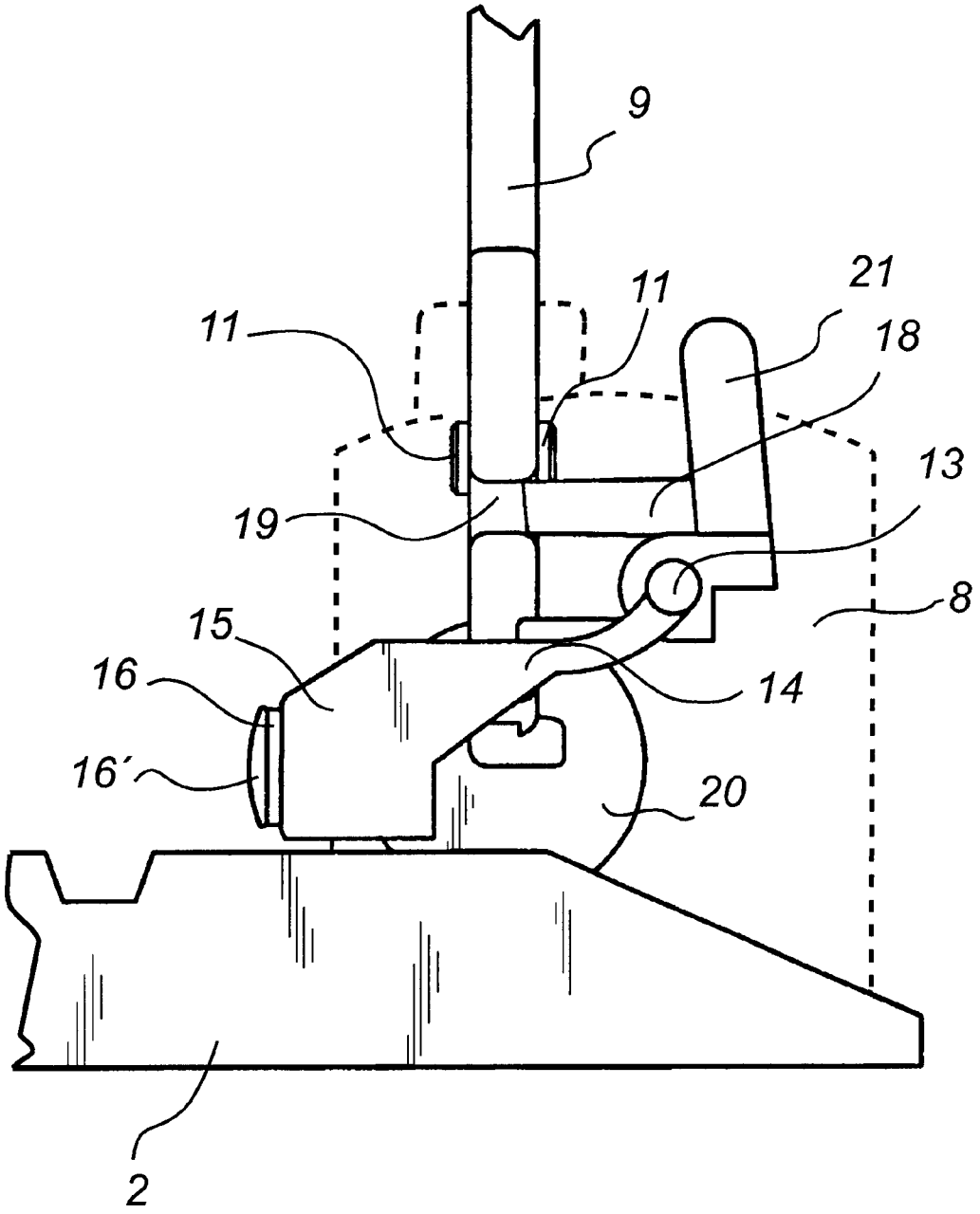
FIG. 4 is a side view showing the operating means in a first position.

The toy object 3 shown is a level-crossing gate assembly comprising a housing 8 and a level-crossing gate 9 pivotably mounted in a slot 10 in the upper part of the housing 8 by means of two pins 11 extending perpendicularly to the railway track. The level-crossing gate 9 is pivotable between a raised initial position (FIGS. 1 and 4), in which it is inclined at a small angle (here about 10°) relative to the vertical in the direction of the roadway 5, and a lowered active position (FIGS. 2 and 5), in which it extends horizontally across the roadway 5. The housing 8 and the level-crossing gate 9 are made of plastics material.

Figure 3:
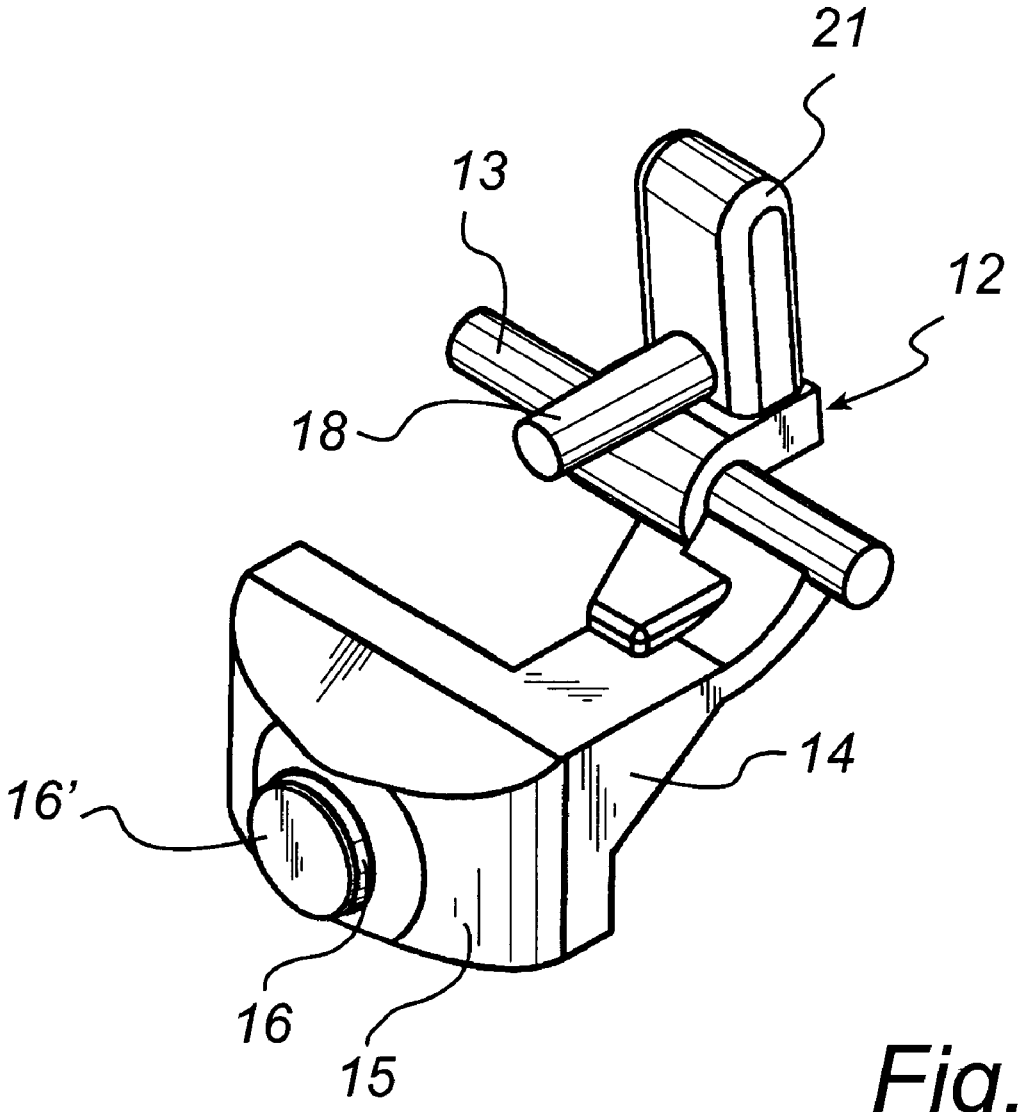
FIG. 3 is a perspective view showing an operating means of the toy object.
Figure 5:
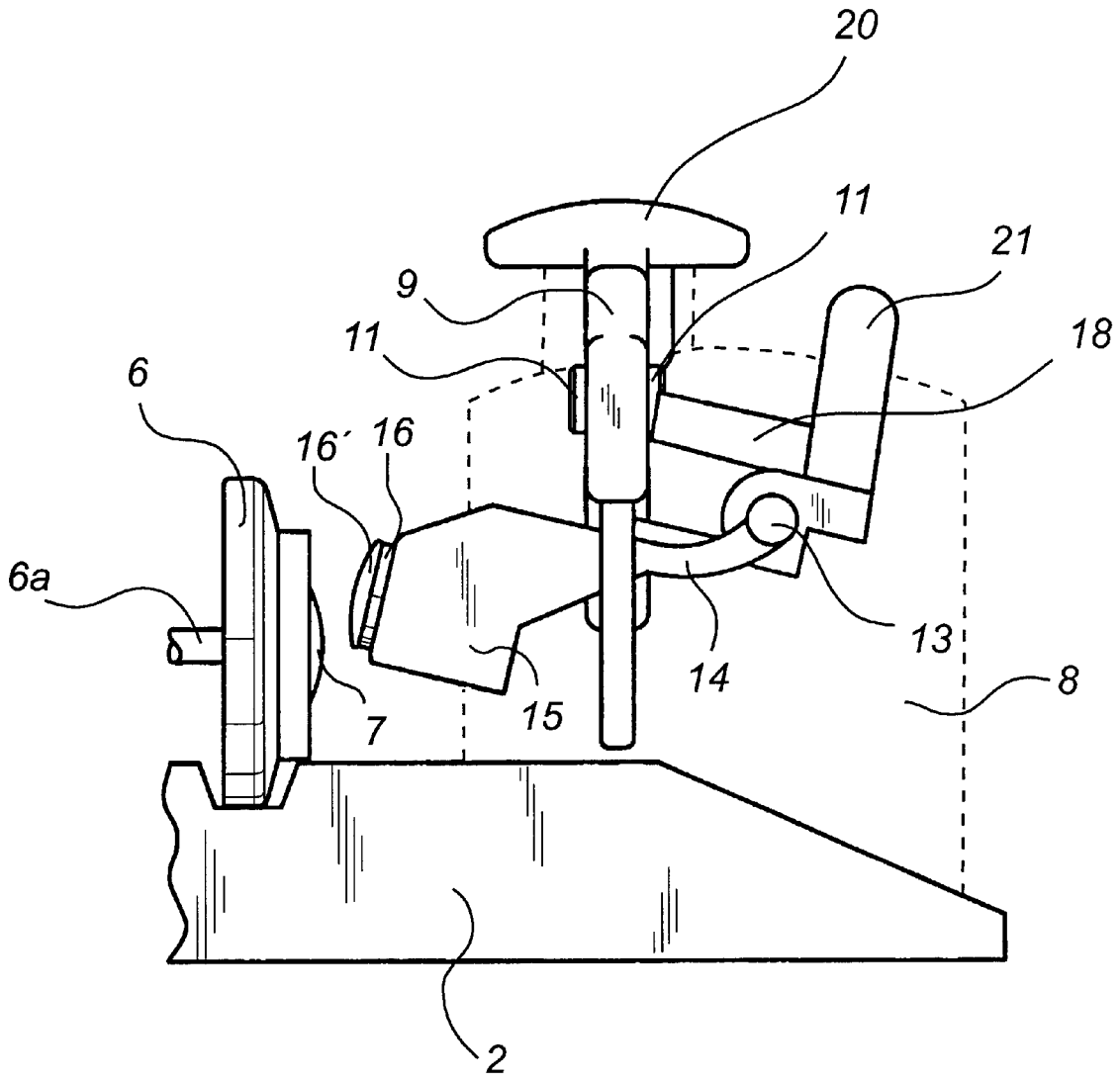
FIG. 5 is a side view corresponding to FIG. 4 but showing the operating means in a second position.

The toy object 3, i.e. the level-crossing gate assembly, also comprises an operating means 12 (see FIGS. 3–5) of plastics material. The operating means 12 is pivotably mounted in the housing 8 by means of a shaft 13 extending parallel to the railway track. The operating means 12 is pivotable between a lowered first position (FIGS. 1 and 4), in which it is kept by its own weight, and a raised second position (FIGS. 2 and 5).

The operating means 12 has an arm 14 extending forwards from the shaft 13, i.e. in the direction of the railway track perpendicularly to the shaft 13, and having at its front end an enlarged portion 15 giving the operating means 12 such a weight distribution that it is normally kept in its lowered first position.

The enlarged portion 15 of the arm 14 supports a disk-shaped magnet 16 made of so-called supermagnetic material. The magnet 16 has a through hole in its center and is attached to the enlarged portion 15 by means of a rivet 16' which is made of plastics material and the shank of which extends through the hole of the magnet 16. The front part of the enlarged portion 15 with the magnet 16 extends to a position outside the housing 8 through an opening 17 therein.

The operating means 12 further has a peg 18 formed on the upper side of the shaft 13 and extending perpendicularly thereto in the direction of the railway track. The peg 18 has such a length that its front end is inserted in a cut out 19 in the level-crossing gate 9 to hold the latter in its raised position (see FIG. 4) when the operating means 12 is in its lowered first position. When the operating means 12 is pivoted from its first position to its raised second position the front end of the peg 18 is removed from the cut out 19 and sets the level-crossing gate 9 free to fall down to its lowered active position (see FIG. 5).

The level-crossing gate 9 has at one end thereof a button-like plate 20 adapted to be pressed down manually by means of a finger to pivot the level-crossing gate 9 from its lowered position to its raised position.

The operating means 12 further has a key 21 formed at the rear upper part of the operating means 12 and projecting through a slot 22 formed in the upper part of the housing 8. The key 21 can be manually operated by means of a finger to pivot the operating means 12 from its lowered position (FIG. 4) to its raised position (FIG. 5).

FIG. 1 shows the toy vehicle 1 approaching the toy object 3, the level-crossing gate 9 being in its raised position, in which it is held by the peg 18 of the operating means 12, which by its own weight is kept in its lowered first position. When the toy vehicle 1 has arrived at the position shown in FIG. 2, its left front wheel 6 is facing the magnet 16 supported by the operating means 12, whereby, as a result of the magnetic action, the magnet 16 of the operating means 12 is attracted to the hub-cap-like part 7 of the left front wheel 6 causing the operating means 12 to pivot from its lowered first position to its raised second position and thereby causing the level-crossing gate 9 to fall down to its lowered active position, in which it extends horizontally across the roadway 5.

When the toy vehicle 1, or rather the toy train, has passed the roadway 5, the level-crossing gate 9 is brought back to its raised position by pressing down the key 21 by means of a finger. The operating means 12 will fall back to its lowered first position by its own weight.

As will be appreciated, the described toy system can be modified in many different ways within the scope of the invention. Thus, the locomotive can be replaced by another toy vehicle and the level-crossing gate assembly can be replaced by another toy object having a movable member, e.g. a semaphore, other than a level-crossing gate. A magnetic attractive force between the operating means 12 and the hub-cap-like part 7 of the wheel 6 will also exist if the part 7 is a permanent magnet and the magnet 16 is replaced by a member made of magnetic material, or if the part 7 is replaced by a permanent magnet oriented such that the portions of the two magnets facing each other have opposite polarity (north and south). It should also be noted that the magnetic interaction between the operating means 12 and the hub-cap-like part 7 of the wheel 6 may be based upon a magnetic repellent force, when the operating means 12 is correspondingly designed. Such a repellent force is created when the two magnets mentioned above are oriented such that said portions thereof have the same polarity (north or south). Finally, it should also be noted that the hub-cap-like part 7 of the wheel 6 can be replaced by another part for magnetic interaction with the operating means. For instance, the shaft 6*a* of the wheel 6 (see FIG. 5) may be used as such a part provided it is made of an appropriate material.

I claim:

1. A toy system comprising at least one toy vehicle having wheels, and at least one toy object having a member, which is movable between an initial position and an active position, wherein the toy object has an operating means, which is movable between a first position, in which it is adapted to hold said member in its initial position, and a second position, in which said member is allowed to be moved from its initial position to its active position, and wherein at least one of the wheels of the toy vehicle includes a part which is adapted, when the toy vehicle is moved to a position adjacent to the operating means, to interact magnetically with the operating means to move it from its first position to its second position.

2. A-toy system as claimed in claim 1, wherein the operating means supports a permanent magnet and said part is made of a magnetic material and hence is adapted to interact with the operating means by magnetic attraction.

3. A toy system as claimed in claim 1 or 2, wherein said part is a hub-cap-like part.

4. A toy system as claimed in claim 1, wherein said member is influenced by a force acting in the direction of the active position of said member.

5. A toy system as claimed in claim 4, wherein said force is the force of gravity.

6. A toy system as claimed in claim 1, further comprising a rail element, which is a component of a toy railway, wherein the toy vehicle is adapted to be moved on the rail element and the toy object with the operating means is mounted on the rail element.

7. A toy system as claimed in claim 6, wherein the movable member of the toy object is a level-crossing gate, which is pivotable between a raised initial position and a lowered active position.

* * * * *